US006068538A

United States Patent [19]

Alleyne

[11] Patent Number: 6,068,538

[45] Date of Patent: May 30, 2000

[54] WRAP-AROUND SPORTS BRA

[76] Inventor: Julia Alleyne, 2042 Pineview Drive, Oakville, Ontario, Canada, L6H 4Z8

[21] Appl. No.: 09/083,682

[22] Filed: May 22, 1998

Related U.S. Application Data

[60] Provisional application No. 60/047,524, May 23, 1997.

[51] Int. Cl.[7] ..... A41C 3/02

[52] U.S. Cl. ..... 450/58; 450/70; 450/79; 450/1

[58] Field of Search ..... 450/1, 5, 8–12, 450/17, 23, 26, 28, 30, 39, 58, 70, 79, 80, 82, 84, 85, 89; 2/104–106, 109, 110, DIG. 1

[56] References Cited

U.S. PATENT DOCUMENTS

| | | | |
|---|---|---|---|
| 1,545,441 | 7/1925 | Newman et al. | 450/57 |
| 1,672,770 | 6/1928 | Mountain | 450/70 |
| 1,878,755 | 9/1932 | Caldor | 450/70 |
| 2,753,563 | 7/1956 | Blitch | 450/70 |
| 3,507,285 | 4/1970 | Williams | 450/70 |
| 4,024,876 | 5/1977 | Penrock | 450/58 X |
| 4,804,351 | 2/1989 | Raml et al. | 450/58 |
| 4,911,677 | 3/1990 | White | 450/36 |
| 5,180,326 | 1/1993 | Williams | 450/79 X |
| 5,378,192 | 1/1995 | Darmante | 450/70 X |
| 5,697,830 | 12/1997 | White | 450/70 |

OTHER PUBLICATIONS

Title 9 Sports Catalog, Fall–Winter 1997, p. 26, "Smoothsport Bra", item #310309.

Gale Gehlsen & Marge Albohm, 1980, "The Physician and Sports Medicine", vol. No. 10, p. 89 to p. 96.

*Primary Examiner*—Gloria M. Hale

*Attorney, Agent, or Firm*—Dinsmore & Shohl LLP

[57] ABSTRACT

The present invention is directed to a wrap sports bra for supporting breast tissue and back muscles, the bra comprises first and second front panel sections joined to a common back portion, each front panel section being configured to define a seamless cup to support a breast, an elasticized bottom edge located along the bottom of the front panel sections and the back portion and a fastening means allowing for wrap around fastening of each front panel section to the opposite front and side of the front panel section.

16 Claims, 5 Drawing Sheets

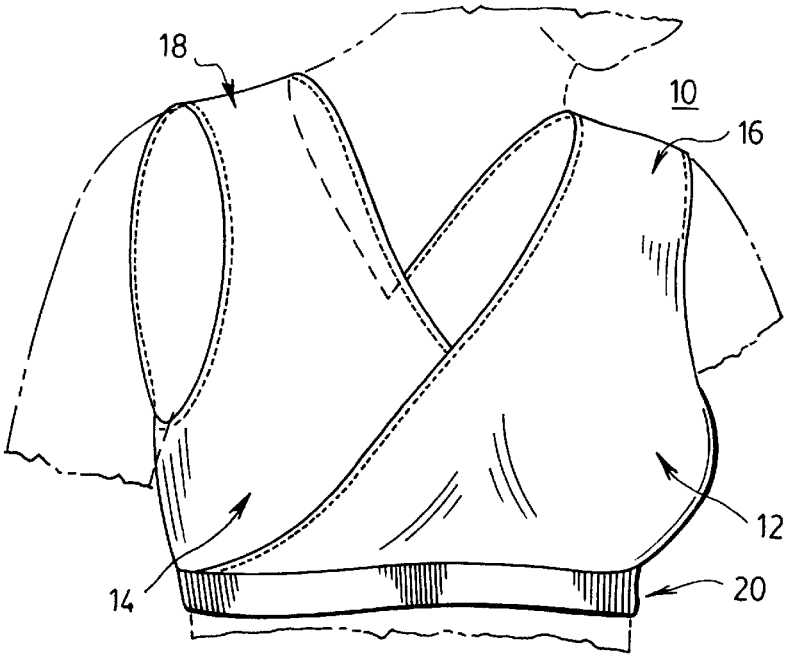
FIG.1.
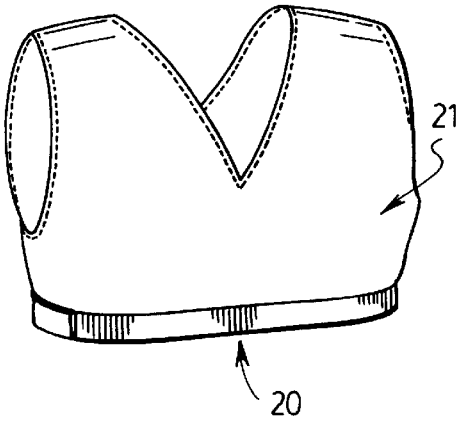
FIG.2A.
FIG.2B.
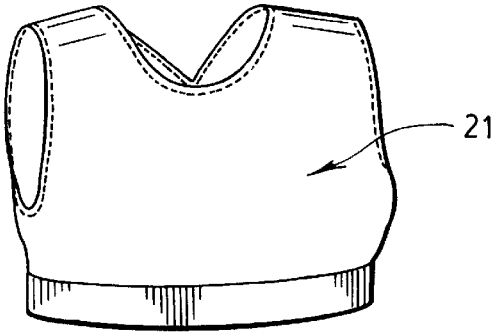

WRAP-AROUND SPORTS BRA

This Application claims benefit of Provisional Application No. 60/047,524 filed May 23, 1997.

FIELD OF THE INVENTION

This invention relates to sports tops in general and more particularly to a wrap-around sports bra.

BACKGROUND OF THE INVENTION

Sports bras have been developed for those women who are active and enjoy participating in a variety of sports activities. Sports bras are designed to better support and minimize the movement of the breasts during exercise. Specifically, they were initially designed to reduce the vertical displacement of the breast and eliminate the "bounce factor". However, sports bras are also worn by women who have larger breasts and feel more comfortable in a bra that is designed to better support and hold the breasts tightly to the body. Women who do not engage in sports activities also enjoy wearing sports bras because of the style and comfort they afford. Sports bras also provide additional support of the breasts during menstruation when breasts may become swollen and tender.

Several different designs of sports bra are currently available for women. For example, the Jogbra™ has thin straps which are crossed in the back. The bra is designed to squeeze the breasts firmly to the body. The Sport Bra™ is also designed with thin shoulder straps and has a low-cut back. Playtops™ is a criss-crossing bra with thin shoulder straps and a wide low-cut back. There are several design flaws associated with these sports bras which lead to discomfort, pain and swelling of the breasts and/or nipples as well as can cause discomfort and pain of the shoulder and back region. In many cases the design of the bra causes excessive squeezing of the breasts tightly to the chest which can cause breast soreness. The straps are often very thin and cut into the shoulders of women, particularly larger and more robust women. In addition, while the bras try to provide comfort and support to the breasts, they are not designed to provide any comfort or support for the back muscles which help to support the chest in an upright and better postured position.

Other design problems associated with sport bras is that they typically have very tight non-adjustable elasticized rib bands which are designed to hold the bra firmly in place on the torso. Such rib bands may typically cause skin irritations leading to abrasions, bruising and tenderness. Another problem associated with the sport bras currently available for women today is that they are difficult to put on. This is because sport bras are typically designed to be placed on over the head and thus require stretching of the elasticized rib band in order to do so. Other bras typically have clasps that must be fastened on the back.

There is therefore a need to develop a sports bra which is easy to put on and comfortably supports the breast and the back muscles thereby reducing the potential of breast injury and discomfort as well as reducing back and shoulder discomfort during wearing of the bra.

SUMMARY OF THE INVENTION

In accordance with the present invention there is provided a novel sports bra which provides comfortable support of the breasts and minimizes the adverse effects of severe compression of the breast tissue as well as the adverse effects of excessively tight bands around the rib cage. In addition, the novel sports bra of the present invention minimizes nipple irritation, skin abrasions, bruising and reduces chaffing. The sports bra is a wrap-around style of bra which allows for easy putting on of the bra and fastening thereof as well as allows for adjustability as the bra can be snugly adjusted about the rib cage. In addition, the bra can be made with several added and different features depending on the water's preference and use for the bra.

According to an aspect of the present invention there is provided a sports bra for supporting the breasts and the back muscles, the sports bra is a wrap around style for supporting breast tissue and back muscles, the bra comprising a first and second front panel sections joined to a common back portion, each front panel section being configured to define a seamless cup to support a breast, an elasticized bottom edge located along the bottom of the front panel sections and the back portion and a fastening means allowing for wrap around fastening of each front panel section to the opposite front and side of the front panel section.

According to a further object of the present intention, the sports bra additionally comprises curved support bands for additional support of the breasts. In yet a further embodiment, the invention also comprises a pair of crossed "X-shaped" support bands on the inside back portion of the bra.

BRIEF DESCRIPTION OF THE DRAWINGS

A detailed description of the preferred embodiments are provided herein below with reference to the following drawings in which:

FIG. 1 is a front perspective view showing the wrap-around sports bra in a preferred embodiment;

FIG. 2A is a back perspective view showing the wrap-around sports bra of FIG. 1;

FIG. 2B is a back perspective view showing the wrap-around sports bra of FIG. 1A;

Figure 3A:
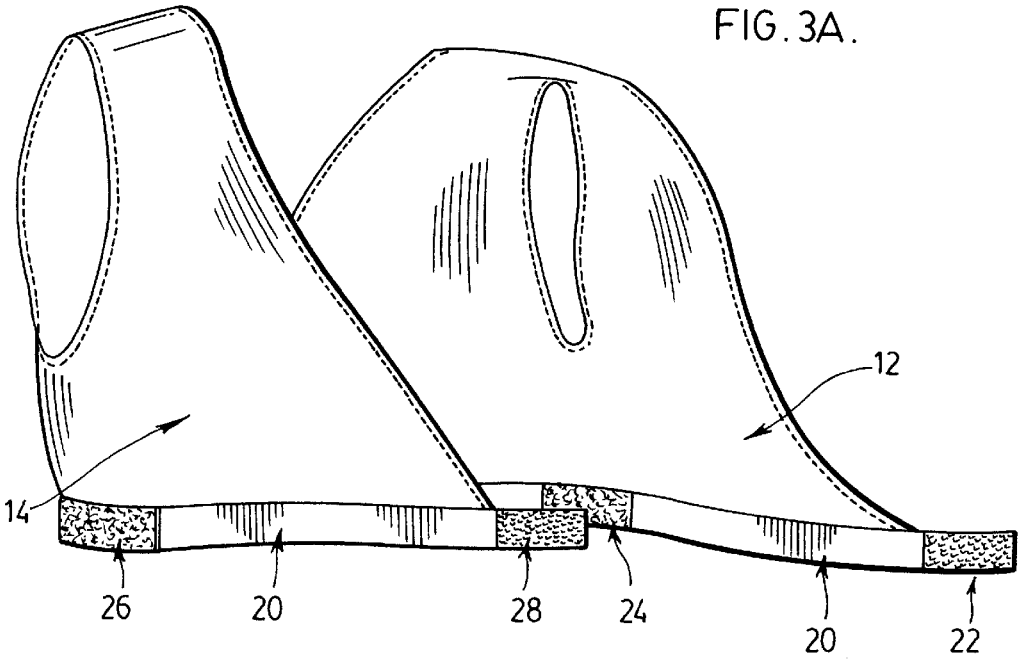
FIG. 3A is front perspective view of the wrap-around sports bra of FIGS. 1 and 2 in an unfastened position.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

It has been several years since manufacturer's first designed the sport bra as garment for women to use while they exercise. Initially, manufacturer's thought that women would feel more comfortable exercising if they were able to reduce the vertical displacement of the breast and therefore eliminate the "bounce factor". After many modifications to the to the garment, women still complain that they can't get enough support of their bra digs into their shoulders and is too tight around the ribs. In an age where sport is actively promoted, exercise is an effective intervention to reduce disease and illness. Healthy breast care has become a growing concern for women of all ages and body types. Breast pain in exercisers often leads to a reduced frequency and intensity of exercise, yet women do not feel comfortable approaching health care professionals about issues related to healthy but painful breasts. Non-cancerous breast pain seems to fall between the cracks in realm where health care professionals are needed to take leadership.

The breast is essentially a "sophisticated sweat gland" considered a solid structure with a gelatin-like consistency. It is composed of fatty lobules with sebaceous glands, ducts and connective tissue. The arreolar area contains dense nerve innervation and the vascular supply enters through the anterior shoulder, axilla and lower lateral breast area. The only muscle found in the breast is in the ductal system of the nipple and has an erectile function. The breast sit on top of the bony thorax cage and over the pectoralis muscle group. Therefore, the breast tissue is exposed and when compressed, irritated or subject to contact can become irritated, inflammed, bruised and chafed.

In analyzing garment construction, there are elements that directly oppose the natural physiology of the breast. The areas of greatest vascularization are also the areas where shoulder straps exert pressure or rib bands compress tissue. The sensitive nipple area is often compressed and subject to seams and fabric ridges. The lateral breast has the highest accumulation of fatty tissue and is exposed to compression and pinching from the lateral panels of the garment. A better match between physiology and garment construction may ease some breast problems. The correct fit of the bra is key to comfort and many women don't realize their correct size or that their size changes along with other body changes. The present invention provides a comfortable bra that has a unique design and construction which prevents and helps to alleviate breast problems associated with an improperly designed and fitted sports bra.

Referring to FIG. 1, there is illustrated the wrap-around sports bra of the present invention which is generally referred to with reference numeral 10. The wrap around sports bra comprises two front panel sections 12, 14 of which one panel section 12 is designed to partially overlap the second panel section 14. The front panel sections are configured to define seamless cups. The sports bra has wide shoulder straps 16, 18 and has a V-shaped neck region. An elasticized band 20 is present on the bottom portion of the front panels and extends all around the bra so as to fit comfortably, but not tightly around the rib cage. As seen in FIG. 2 the sports bra also has a V-shaped back neck portion and a back portion 21 which is continuous at either side with each front panel section. This back portion of the bra helps to support the back muscles. As seen in FIG. 2B, the back neck portion may be designed as a scoop-neckline.

Figure 3B:
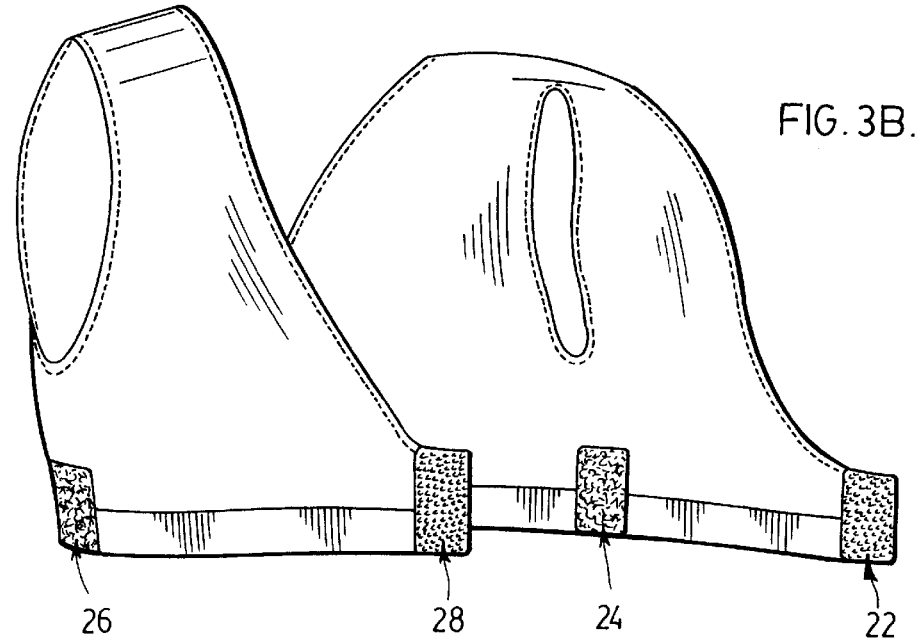
FIG. 3B is a front perspective view showing the wrap-around sports bra of FIG. 3A in another embodiment.

As is better illustrated in FIG. 3, the first panel section 12 has an adjustable fastener, preferably of a hook and loop fabric better known as VELCRO™, located at two positions 22, 24 on the elasticized band below the first panel section which engage with corresponding fasteners 26, 28 located on the elasticized band 20 below the second panel section 14. FIG. 3B illustrates a further embodiment of the sports bra showing larger and more vertically orientated VELCRO™ (hook and fabric material) fasteners provided at the same locations as shown in FIG. 3. In both embodiments, fasteners extend along a length of the elasticized band just under each armpit section. In this manner the bra is slipped on and secured about the breasts and ribcage by engaging the fasteners. The fasteners can be made of varying sizes (i.e. lengths and widths) in order to provide for adjustment of the tightness of the bra about the rib cage and support for the breasts. This type of hook and loop fastener is also easy to fasten and unfasten and thus provides for a simple and fast way of adjusting the wrap-around sports bra in order to fit comfortably. This type of fastener also allows for easy dressing and also for a better adjustment of the bra about the breasts and ribs without excessive squeezing or compression of the breasts. It is understood by those skilled in the art that while VELCRO™ (hook and fabric material) fasteners are preferred for use in the present invention other suitable fasteners such as eyelet closures may also be used in the present invention.

The bra is constructed of at least one layer of stretchable power knit material which provides both vertical and horizontal stretch. A preferred material is COOLMAX™, POWERLYCRA™ or reinforced LYCRA™ which provides stretch, support, breathability for the skin and reinforcement. The material should also be washable and retain its shape and function upon washing. Those skilled in the art would understand that any materials which convey these characteristics are appropriate for use in the present invention. It is also understood that the sports bra of the present invention can be fabricated in one piece or several pieces which are stitched together so long as the front panel sections defining cups are relatively seamless and the front wrap-around style of the bra is maintained.

The wrap around design of the sports bra of the present invention provides the necessary support required for the breasts without excessive and harmful compression of the breasts against the chest. The wide shoulder straps both in the front and back of the bra provide support for both the breasts as well as the back muscles thus encouraging better posture and comfort during its wear. The wide back portion also provides support and comfort to the back muscles. Although the width of the shoulder straps may vary, it is preferred that the straps be approximately 2.5" to 5.0" wide in order to provide for the best support and comfort and to prevent cutting into the shoulders and pinching.

The design also does not require the use of tight bands around the ribcage but rather provides a wide elasticized band at the bottom of the bra to ensure that the bra stays placed below the breasts. The elasticized band can vary in width, however, it is desired that the band be at least 1.0 inch in width. The design allows for easy and fast adjustment of the fit of the bra by providing VELCRO™ (hook and fabric material) fasteners. This allows for a more "personalized" fit compared with standard sized sports bras. The length of the fasteners may also vary thus providing for a greater degree of adjustment about the breasts and ribs.

The sports bra of the present invention can be made in various standard sizes such as small, medium, large and extra large as well as provide for different cup sizes of the front panels in order to accommodate various breast sizes. This is especially ideal for pregnant and breast feeding women as it is at these times that the breasts enlarge. The sports bra can also be made to be longer or shorter on the torso in order to fit better on women of different heights. Sizing to accommodate different torso height is particularly advantageous in order that the bra fit properly and at a suitable location on the rib cage.

Figure 4:
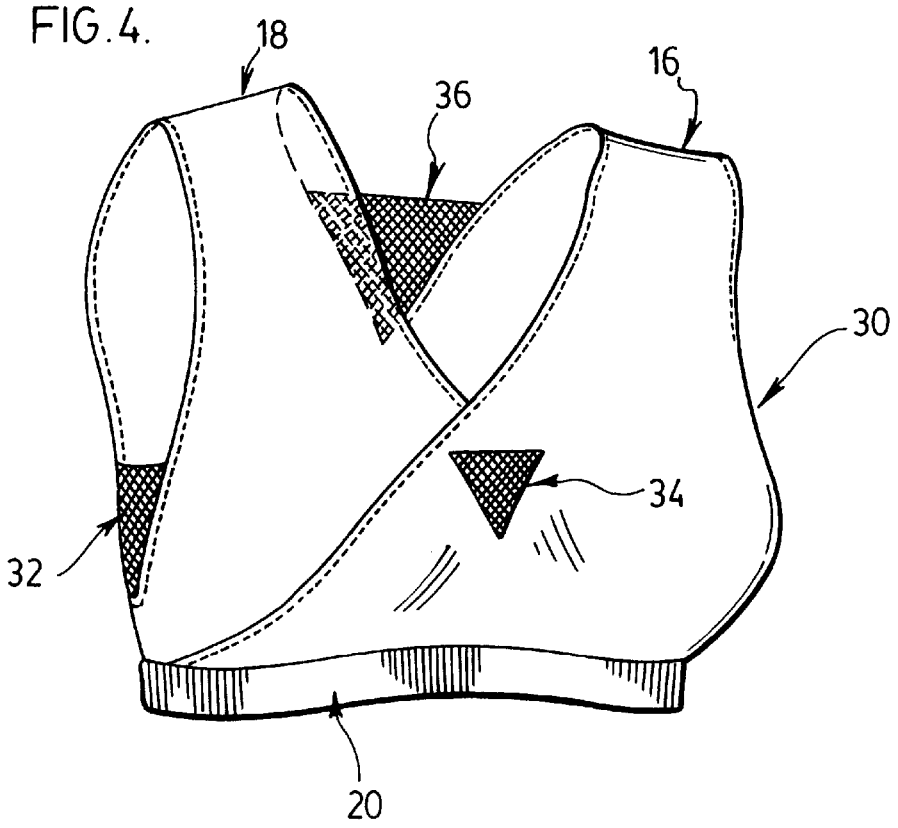
FIG. 4 is a front perspective view showing the wrap-around sports bra in accordance with another embodiment of the present invention.

In a second embodiment illustrated in FIG. 4, the wrap around sports bra is constructed to have ventilation mesh inserts located under each arm pit region 30, 32 as well as in the middle portion of the chest 34. A mesh insert 36 is placed in the back V-shaped or scoop-neck shaped neck region. Such inserts allow for better air circulation and contact with the skin to allow for evaporation of perspiration in order to cool the body.

Figure 5:
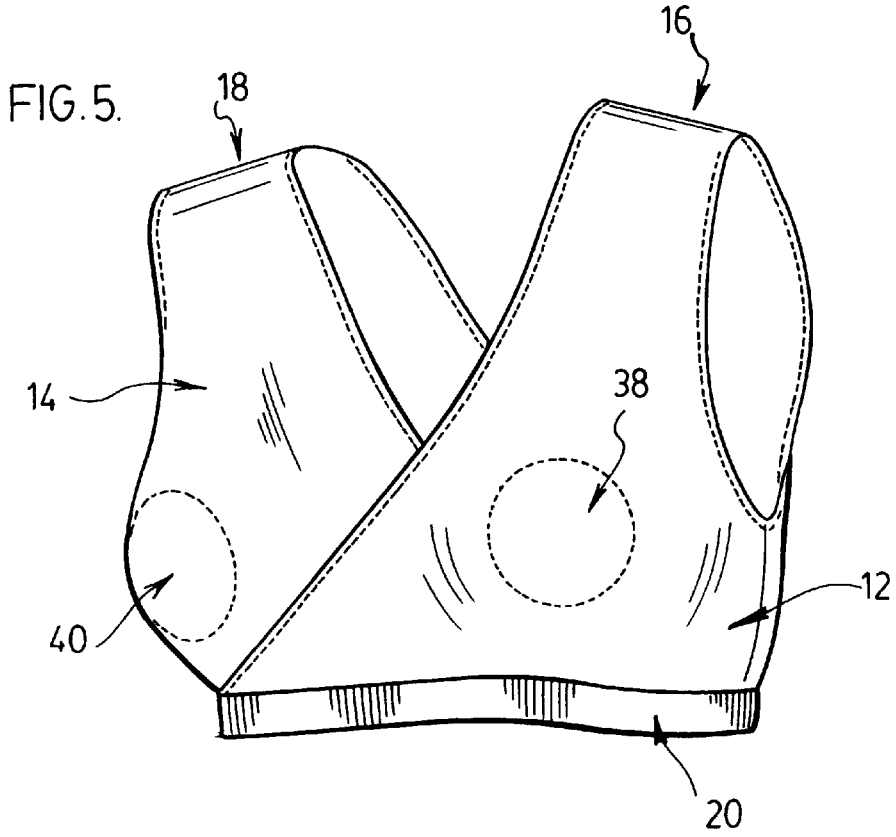
FIG. 5 is a front perspective view showing the wrap-around sports bra in accordance with another embodiment of the present invention.

Another embodiment of the present invention is shown in FIG. 5. Pocket inserts 38, 40 are fabricated within each front panel in order to accommodate a gel pack which serves to reduce friction of the nipples rubbing against the material of the bra. This gel insert thus acts to absorb constant friction and reduce nipple abrasions during exercise. A molded cup can also be inserted within the pocket inserts to provide a "fuller" breast appearance and support of the breast with very minimal or no breast tissue compression. While the bra is shown to have pocket inserts for insertion of gel packs or other friction absorbing material or molded cups, it is understood by those skilled in the art that such friction absorbing gels, pads and molded cups can be made integrally within the front panels of the bra so that they are not removable.

Figure 6:
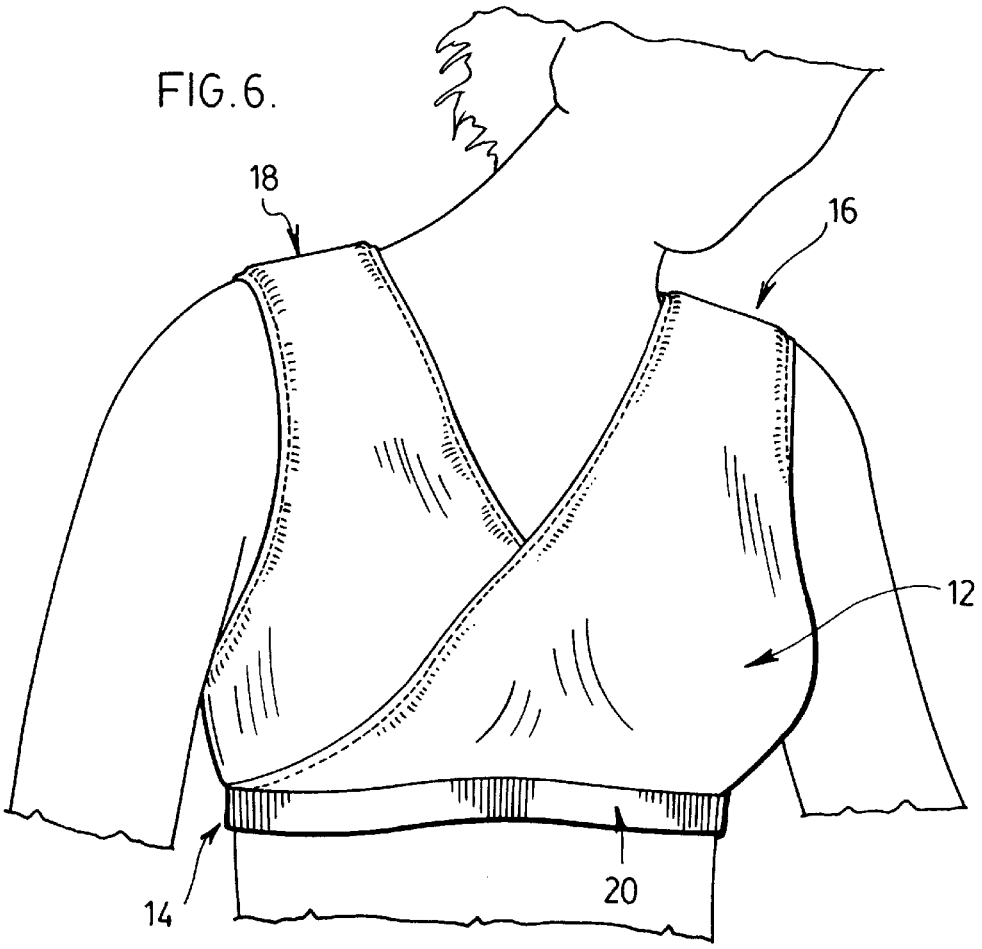
FIG. 6 is a front perspective view showing the wrap-around sports bra in accordance with another embodiment of the present invention.

Another embodiment of the present invention is shown in FIG. 6. In this embodiment a wrap made of padding is secured or sewn onto the bra. Such padding should also be enclosed in a suitable reinforced LYCRA™ or like material. The bra having a padding sewn or adhered thereto is appropriate for those women engaging in particularly physical contact sports such as martial arts, baseball, football or boxing and which require additional protection of the breasts.

Figure 7:
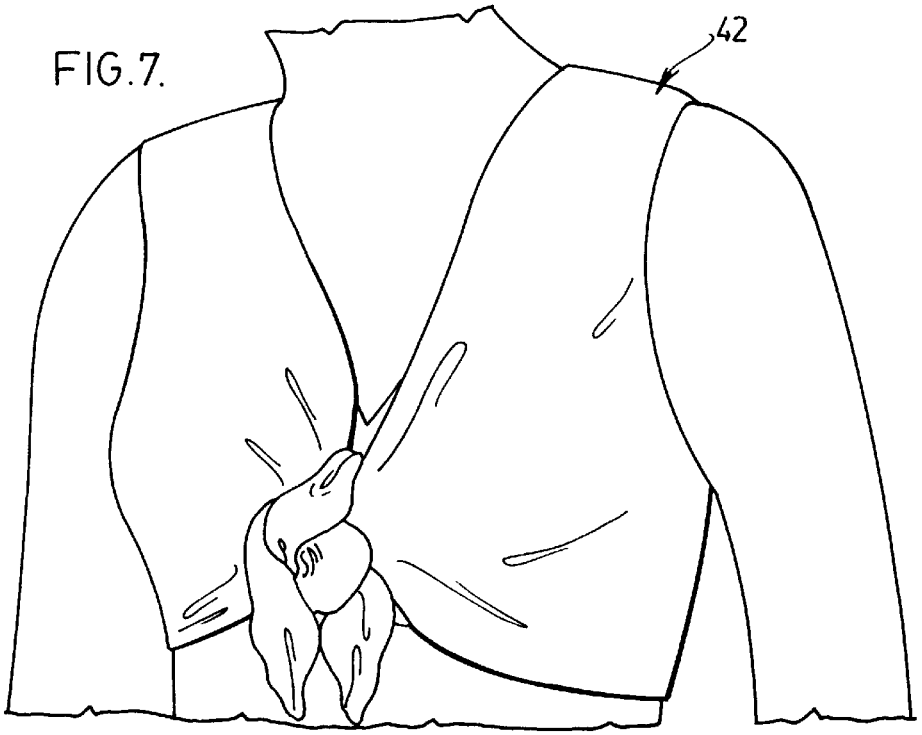
FIG. 7 is a front perspective view showing the wrap-around sports bra in accordance with another embodiment of the present invention.

As shown in FIG. 7, the sports bra of the present invention can be designed with a decorative wrap drape 42 that can be worn over the bra and fastened with VELCRO™ (hook and fabric material to the outside of the bra. The decorative drape can also be sewn directly onto the bra. By providing such a decorative drape, women will feel more comfortable wearing the bra during activity without the need for wearing a T-shirt or other cover on top of the bra. The drape can be made of any suitable fabric and in any colour. The providing of a more decorative and fashionable bra in no way alters the basic function of the bra and that is to comfortably support the breasts and back during exercise.

It is understood by those skilled in the art, that combinations of the different embodiments can be designed. For example, the padded sports bra shown in FIG. 6 can be fabricated to have mesh inserts as shown in FIG. 4 or have gel pocket inserts as shown in FIG. 5. Therefore, many different styles of the bra can be made and worn comfortably. While the present invention provides a wrap-around sports bra, it is also understood that since the bra can be worn without a T-shirt or other cover, it can also be considered as a "sports top". Therefore, it is understood by those skilled in the art that the present invention can be called either a sports bra or a sports top.

Figure 8:
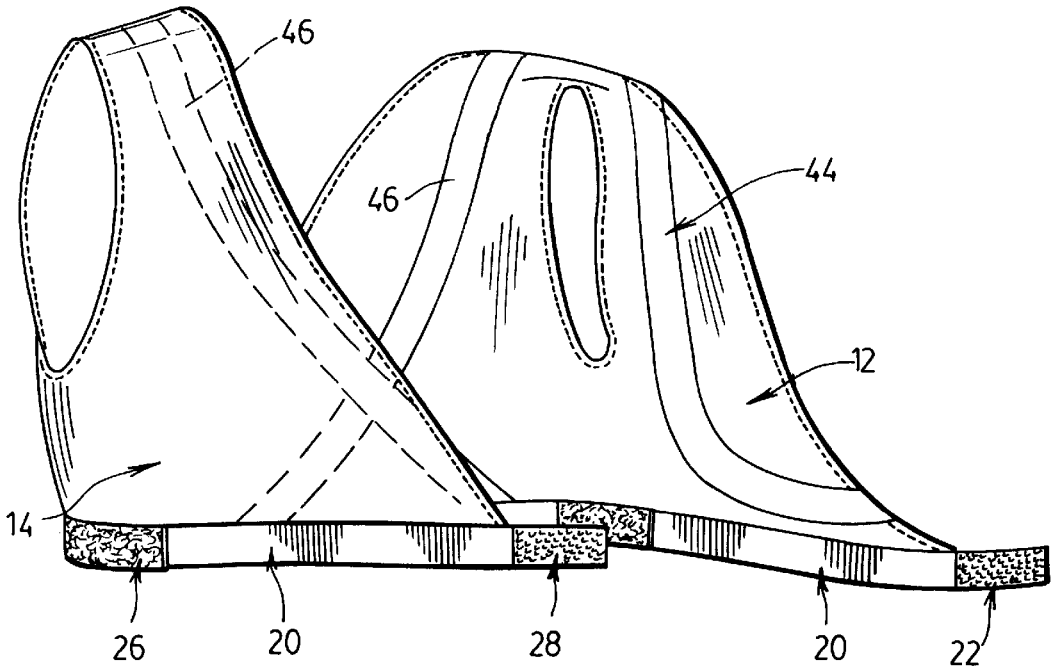
FIG. 8 is a front perspective view showing the wrap-around sports bra in accordance with another embodiment of the present invention.

Although the wrap-around bra of the present invention can be made in varying chest and breast cup sizes and torso length, larger breasted women, pregnant, nursing and women engaging in high impact sports may still require additional reinforcement of the breasts. Additional, LYCRA™ support bands can be provided for this purpose. As shown in FIG. 8, curved front support bands 44 are provided and can be either permanently stitched along its entire length to the inside front panels of the bra or alternatively, removable fastened at one end to the inside of the shoulder of the bra and at the other end to the sup portion of the front panel. These bands are substantially "J" shaped. Such bands act to sling the breast and provide additional comfortable support to large breasted women and act to cradle the breasts. Back bands 46 may also be provided which are straight and crossed and also made of LYCRA™ or like material such as POWERNET™. These bands appear X-shaped on the back inside portion of the bra. These back bands may also be removably fastened to the inside shoulder and inside back portion of the sports bra or permanently stitched to the inside back portion of the bra. It is understood that both the curved and straight back bands may be permanently sewn or otherwise adhered to the inside of the bra.

The design of the sports bra of the present invention is such that it provides much greater comfort to the breasts and back than the design of currently available sports bras. For this reason the bra can be worn for longer periods of time. The style of the bra is also versatile as decorative wraps can be worn with the bra. Alternatively, the bra can be worn alone or on top of a T-shirt or tank top as a sports top. In addition, the bra design can be modified to accommodate different sport requirements and is ideal for both pregnant and nursing women as the bra can be adjusted to accommodate growing breasts and is easy to open and close and thus makes it easy for breast feeding. The bra is also ideal for adolescents to accommodate growth as the bra is adjustable for fit about the breasts and ribcage.

In summary, the present invention provides a wrap around sports bra which provides good breast and back support in a comfortable and stylish design. The wide shoulder straps provide extra support and comfort and prevent the straps from cutting into the shoulders. The bra has seamless cups which cradle and support the breasts without excessive and harmful compression of the breasts tightly against the chest. The bra is easily adjustable about the rib cage and also very easy to place on and wear. Furthermore, the bra can be modified by the addition of gel or other suitable inserts into the front panels in order to reduce any nipple abrasions as a result of friction. Other modifications include the addition of padding, a stylish drape and reinforcement straps.

Although preferred embodiments have been described herein in detail, it is understood by those skilled in the art that variations may be made thereto without departing from the spirit and scope of the appended claims.

What is claimed is:

1. A wrap around sports bra for supporting breast tissue and back muscles, said bra comprising:

first and second front panel sections joined to a common back portion forming a one-piece bra, each front panel section being configured to define a seamless cup to support a breast and to have a wide shoulder strap to maximize comfort, an elasticized bottom edge located along a bottom of the front panel sections and the back portion and a fastening means located at the bottom of each front panel section allowing for wrap around fastening of each front panel section to the respective opposite front panel section such that the breast tissue and back muscles are supported with minimal compression.

2. A sports bra as claimed in claim 1, wherein said fastening means comprises a plurality of adjustable fasteners positioned on the elasticized bottom edge below the first and second panel sections which engage with corresponding fasteners located on the elasticized bottom edge on the respective opposite first and second panel sections.

3. The sports bra as claimed in claim 2, wherein said adjustable fasteners are selected from the group consisting of hook and fabric material and eyelet hooks.

4. The sports bra as claimed in claim 1, wherein said back portion has a V-shaped or scoop-shaped neck portion.

5. The sports bra as claimed in claim 1, wherein said bra additionally comprises ventilation mesh inserts located at a side portion of the front panel sections and in the back portion of the bra.

6. The sports bra as claimed in claim 1, wherein said bra additionally comprises pockets positioned within the first and second front panels to accommodate a gel pack, pad or molding cup.

7. The sports bra as claimed in claim 1, wherein said bra additionally comprises padding secured to the front panels and/or back portion of the bra.

8. The sports bra as claimed in claim 1, wherein said bra additionally comprises support bands for supporting the breast tissue located on inside portions of the first and second front panel sections.

9. The sports bra as claimed in claim 8, wherein a pair of back support bands are additionally provided on an inside of the common back portion of the bra.

10. The sports bra as claimed in claim 8, wherein said bands are made of a spandex material.

11. The sports bra as claimed in claim 1, wherein said bra is made of a reinforced spandex.

12. The sports bra as claimed in claim 1, wherein said elasticized bottom edge is approximately 1 inch to 3 inches in width.

13. A wrap around sports bra for supporting breast tissue and back muscles, said bra comprising:

first and second front panel sections joined to a common back portion forming a one-piece bra;

each front panel section being configured to have a wide top shoulder portion to maximize comfort and to define a seamless cup to support a breast;

an elasticized bottom edge located along a bottom of the front panel sections and the back portion;

a fastening means located at the bottom of each front panel section allowing for wrap around fastening of each front panel section to the respective opposite front panel section; and a removably fastened decorative wrap drape.

14. The sports bra as claimed in claim 9, wherein said bands are made of spandex material.

15. A support band for supporting and cradling the breast, the support band comprising a substantially J-shaped spandex suspension band which is incorporated into a front or back panel of a bra, said suspension band spanning from a top shoulder position to a bottom portion of the front or back panel of said bra.

16. A method of providing maximal support to breast tissue and back muscles comprising the step of wearing a bra comprising:

first and second front panel sections joined to a common back portion forming a one-piece bra, each front panel section being configured to have a wide top shoulder portion and to define a seamless cup to support a breast;

an elasticized bottom edge located along a bottom of the front panel sections and the back portion; and a fastening means located at the bottom of each front panel section allowing for wrap around fastening of each front panel section to the respective opposite front panel section such that the breast tissue and back muscles are supported with minimal compression.

* * * * *